United States Patent [19]

Whelan et al.

[11] 4,052,152

[45] Oct. 4, 1977

[54] DIRECT FLAME DRYING APPARATUS

[75] Inventors: Edward J. Whelan, Hasbrouck Heights; William L. Douma, West Paterson, both of N.J.

[73] Assignee: Sun Chemical Corporation, New York, N.Y.

[21] Appl. No.: 658,902

[22] Filed: Feb. 18, 1976

[51] Int. Cl.[2] ..... F27B 9/14

[52] U.S. Cl. ..... 432/122; 34/105; 101/41; 118/47; 432/124; 432/230

[58] Field of Search ..... 432/124, 230, 122; 65/119, 120; 34/105; 101/41; 118/47

[56] References Cited

U.S. PATENT DOCUMENTS

| | | | |
|---|---|---|---|
| 998,900 | 7/1911 | Hodgson | 34/105 |
| 2,355,459 | 8/1944 | Miskella | 34/105 |
| 2,501,367 | 3/1950 | Wehmiller et al. | 34/105 X |
| 2,561,404 | 7/1951 | Nordquist | 34/105 |
| 3,381,391 | 5/1968 | Yunghahn | 34/105 |
| 3,627,283 | 12/1971 | Hittner | 432/230 |
| 3,701,880 | 10/1972 | Rively et al. | 65/120 |
| 3,815,881 | 6/1974 | McCann | 432/230 |
| 3,840,999 | 10/1974 | Whelan | 432/122 |
| 3,847,540 | 11/1974 | Farfaglia et al. | 34/105 |
| 3,935,647 | 2/1976 | Aschberger | 432/122 |

*Primary Examiner*—John J. Camby
*Attorney, Agent, or Firm*—Cynthia Berlow

[57] ABSTRACT

Cylindrical two-piece cans are decorated with thermally curable inks and coatings and are placed on generally horizontally extending pins of a pin-chain conveyor. The cans are then moved through a flame drying chamber to dry the inks and coatings by direct impingement of flame on the can surface. The cans are thereafter moved through a cooling chamber and then are discharged from the pin-chain conveyor which circulates back to the decorator unit to receive newly decorated cans. The pins of the pin-chain conveyor can be at an angle to the horizontal and the pins can have brushes or the like to grip the internal surface of the can. The flame dryer unit consists of gas and air-fed burner heads disposed in one of several different patterns along the path taken by the cans through the flame dryer housing. Flame impinges directly on the can and the can moves through the tunnel at a speed sufficient to prevent heat damage to the can. A programmable controller controls the number of burners in use at any one time and the individual thermal output of any burner as a function of the speed of the can or pin chain conveyor through the oven.

28 Claims, 19 Drawing Figures

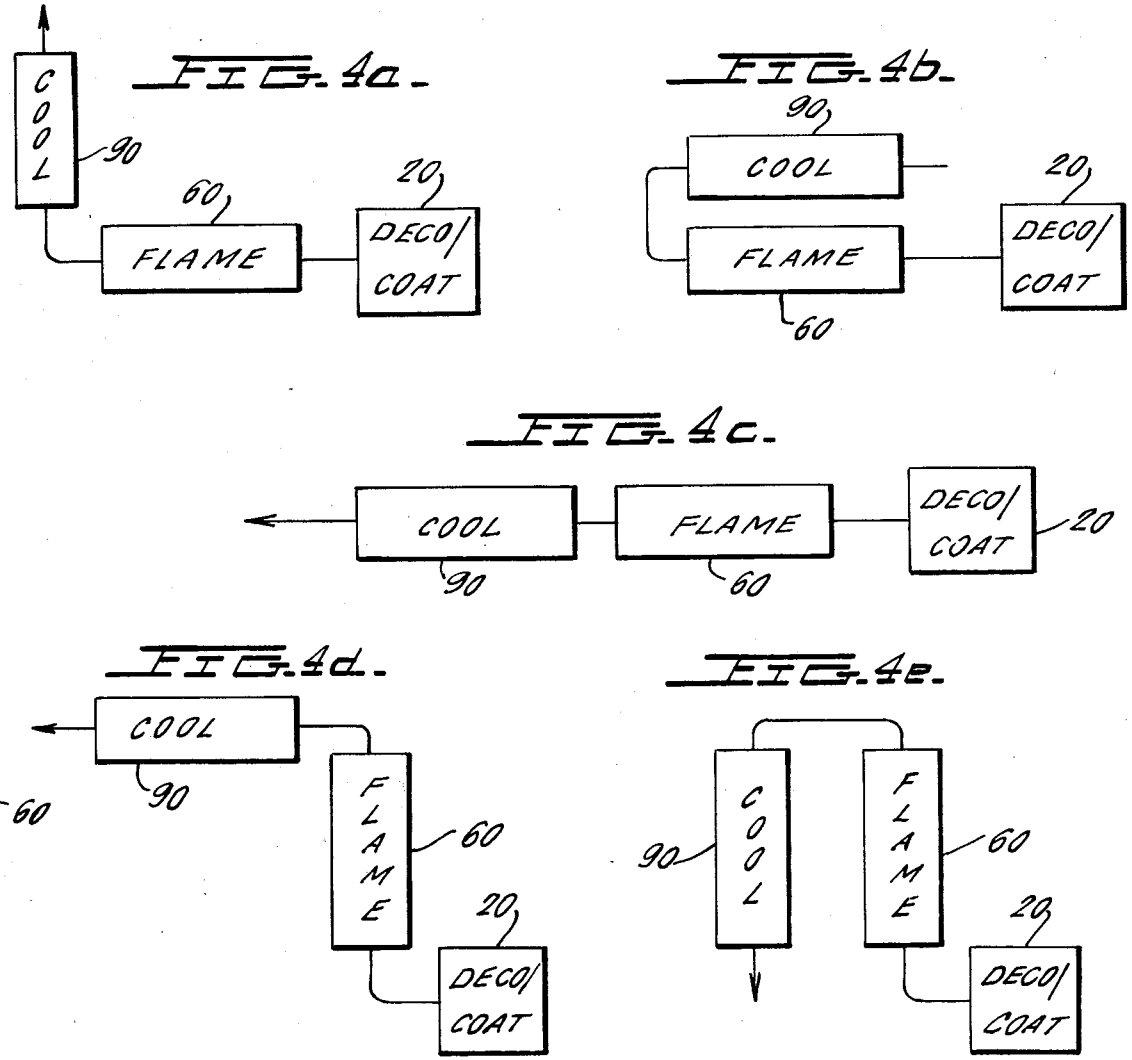
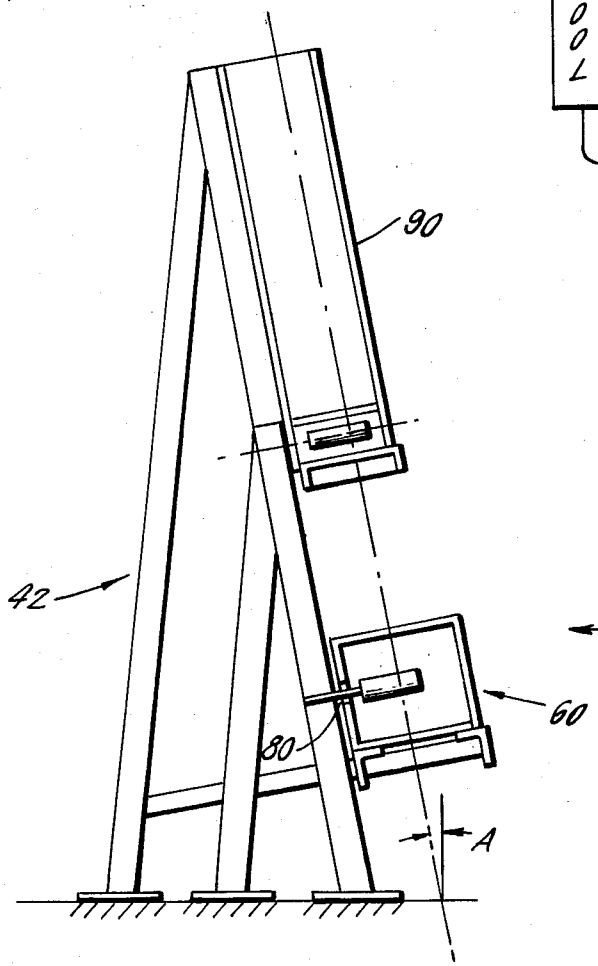
FIG. 8.

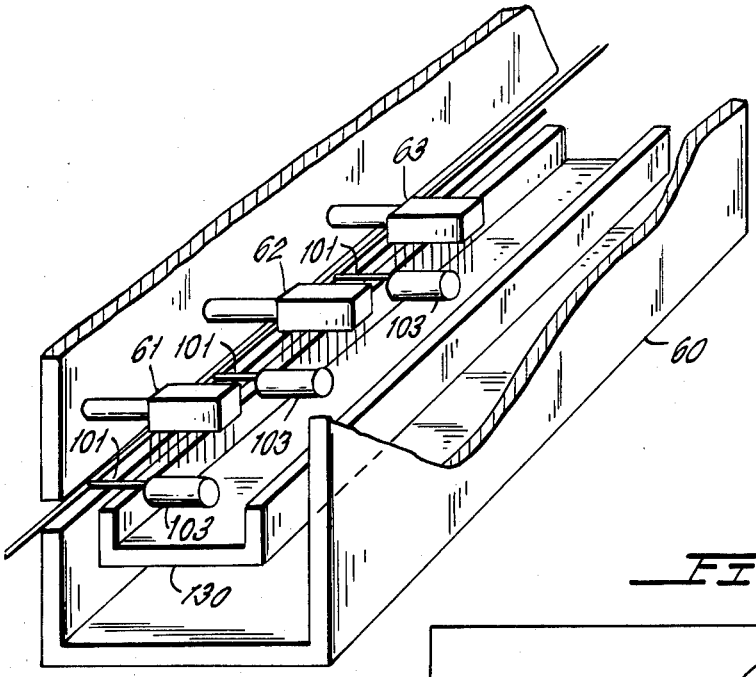
FIG. 11.
FIG. 14.
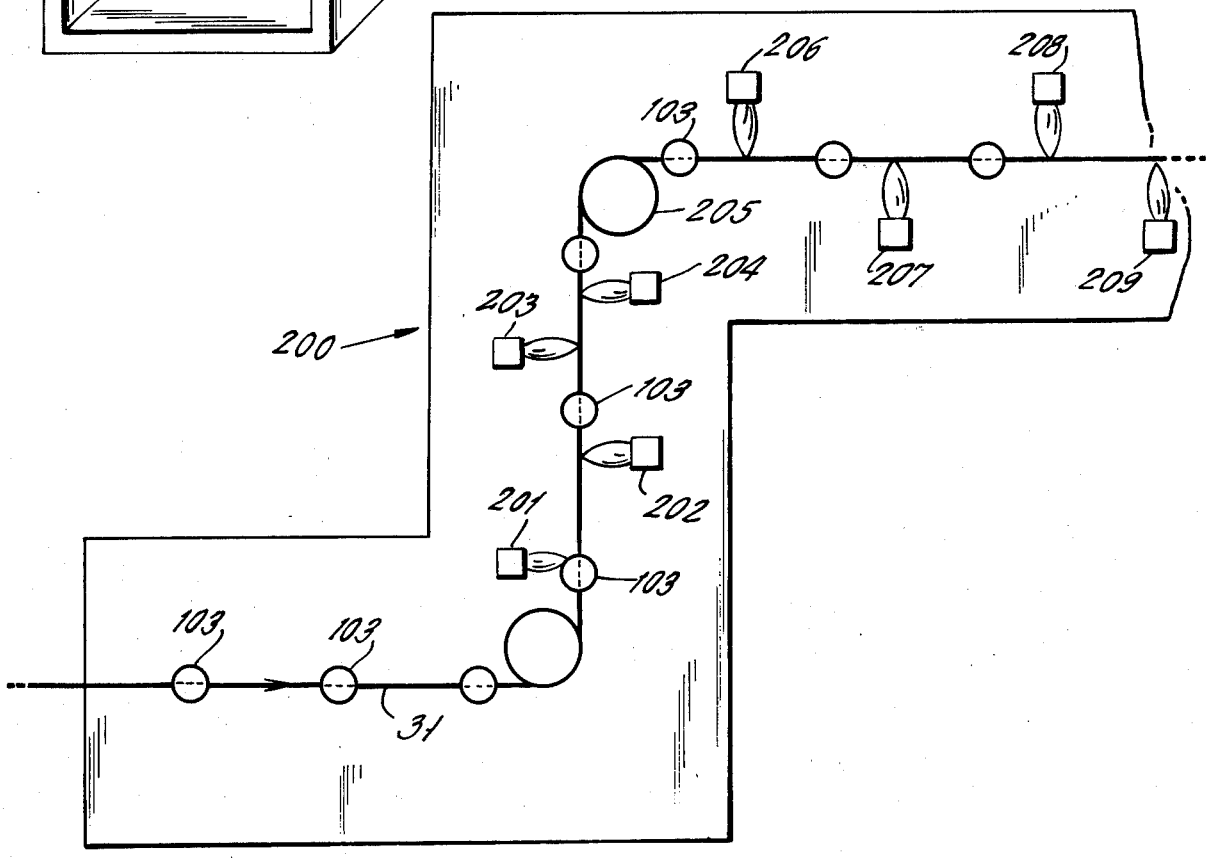
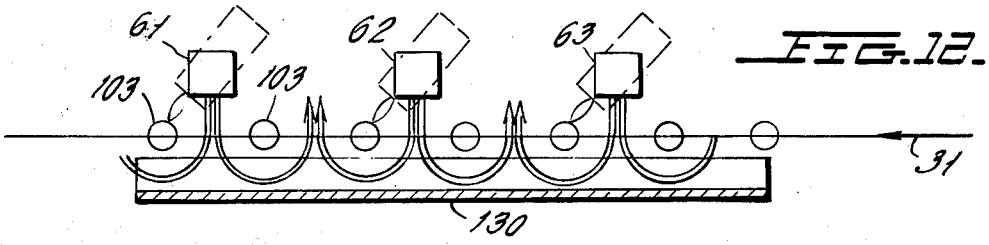
FIG. 12.

DIRECT FLAME DRYING APPARATUS

BACKGROUND OF THE INVENTION

This invention relates to the drying of decorated cylindrical objects such as two-piece metal cans, and more specifically relates to a novel drying system in which the can decoration material consists of thermally dryable inks, varnishes and coatings and in which a gas flame is impinged directly on the decorated can surface.

In the manufacture of a two-piece metal can for containing beverages and the like, the can body is formed and, before it is filled and the top put in place, the can is decorated, as by first placing a base coat on the can and printing a label on the can, and then placing an overvarnish layer on the can. Apparatus for performing these decorating operations are well known, and one high speed device which can decorate cans at rates in excess of 800 can per minute is shown in U.S. Pat. No. 3,766,851 to Sirvet et al, assigned to the assignee of the present invention. This apparatus has a transfer mechanism for transferring the decorated cans to a pin-chain conveyor which conveys the cans to a suitable drying oven.

It is conventional to term apparatus for printing on cans, and for applying overvarnish on cans, as "can decorators" and it is conventional to term apparatus for coating cans as "can coaters". For convenience, the term "can decorator" used herein shall be intended to apply equally to apparatus for individually or collectively printing, coating or varnishing cans. The term "decorating medium" used herein is to refer to any ink, varnish or coating which is applied by the can decorator apparatus.

Presently used drying ovens for curing conventional inks and coatings consist of large, hot air, convection type ovens. When the inks and coatings used for the decoration are ultraviolet curable materials, the curing oven will contain ultraviolet lamps disposed along the path of movement of the decorated cans. A typical ultraviolet curing oven for curing decorated cans is shown in U.S. Pat. No. 3,840,999 in the name of Edward J. Whelan, and assigned to the assignee of the present invention.

The conventional hot air oven takes about 60 to 90 seconds or more to cure a decorated can. Consequently, the oven requires a large volume so that the rapidly moving can remains in the oven for the necessary curing time. Thus, even when the can path is festooned within the oven, the oven requires a large floor space and volume. The flame drying system has been found to cure a decorated can in about three seconds or less. Consequently, the drying stage requires only a small fraction of the area and volume required for the hot air oven.

The use of flame drying will be far more efficient than the hot air oven, and gas consumption will be reduced as compared with the conventional hot air oven. Moreover, the direct flame impingement process will cause the volatile substances driven off during the drying process to be at least partially combusted, thus reducing or completely eliminating the need for afterburning devices to meet current pollution standards.

The system of the present invention is advantageous over present ultraviolet curing systems since the invention allows the use of conventional heat set or thermally cured inks and coatings, as opposed to special ultraviolet curable inks and coatings which are more expensive and not as readily available as conventional heat set inks.

BRIEF DESCRIPTION OF THE PRESENT INVENTION

The present invention consists of a novel combination of components for decorating cylindrical cans and includes a can decorator which can decorate cans with a heat set ink, varnish or coating; a transfer mechanism for transferring decorated cans to a continuously moving closed conveyor pin chain; a flame drying chamber for impinging a gas flame on the cans as the conveyor chain moves the cans through the flame drying chamber; a cooling region following the flame drying chamber to allow the cured cans to cool prior to being removed from the chain; and a can discharge station at which cans are removed from the chain conveyor before the conveyor returns to the decorator.

In the above system, the flame drying unit should be spaced sufficiently from the decorator to allow the uncured coatings or varnishes to become uniform by the flow of the wet coating or varnish over the area of the can to which it is applied, thus eliminating ridges or other irregularities in the quickly cured coating. The conveyor chain of the above system may also be tilted from the vertical so that the can-receiving pins extending perpendicularly from the chain are tilted above the horizontal. This assists in preventing the can from falling off the pin. If desired, the pin can also have means for frictionally engaging the can, such as a wire brush or the like. The pin can also be rotatable about its axis, to cause rotation of the can as the pin and can move through the flame drying oven, thereby to change the distribution of the flame over the surface of the can being dried.

The gas burner heads within the flame drying chamber may be disposed with any desired distribution and spacing. Thus, the burners may be located on one or both sides of the can path through the oven. The burners may be angularly related to the can in any desired way, and in particular may be angularly related so that they are closer to the closed end of the can (which has the greatest mass) than to the open end of the can. Moreover, the flame dryer housing can have an extending reflecting trough extending along its length and disposed on the side of the cans opposite the burner heads for reflecting a hot air stream back toward the cans. An end burner may also be provided to apply flame to the bottom of the can.

BRIEF DESCRIPTION OF THE DRAWINGS

FIG. 2 is an end elevational view of the flame curing and cooling stages of FIG. 1.

FIGS. 4*a* to 4*e* schematically illustrate various typical geometries which the flame drying and cooling stages can take in the arrangement of the system of the invention.

FIG. 11 is a perspective view of a flame dryer unit which is provided with a reflecting trough.

FIG. 12 is a cross-sectional view of the flame dryer unit of FIG. 12 taken through the elongated axis of the dryer to illustrate the operation of the trough.

FIG. 14 schematically illustrates a modified burner housing wherein the can path through the burner executes a 90° change to ensure application of flame to a greater percentage of the exposed surface of a non-rotating can.

DETAILED DESCRIPTION OF THE DRAWINGS

Figure 1:
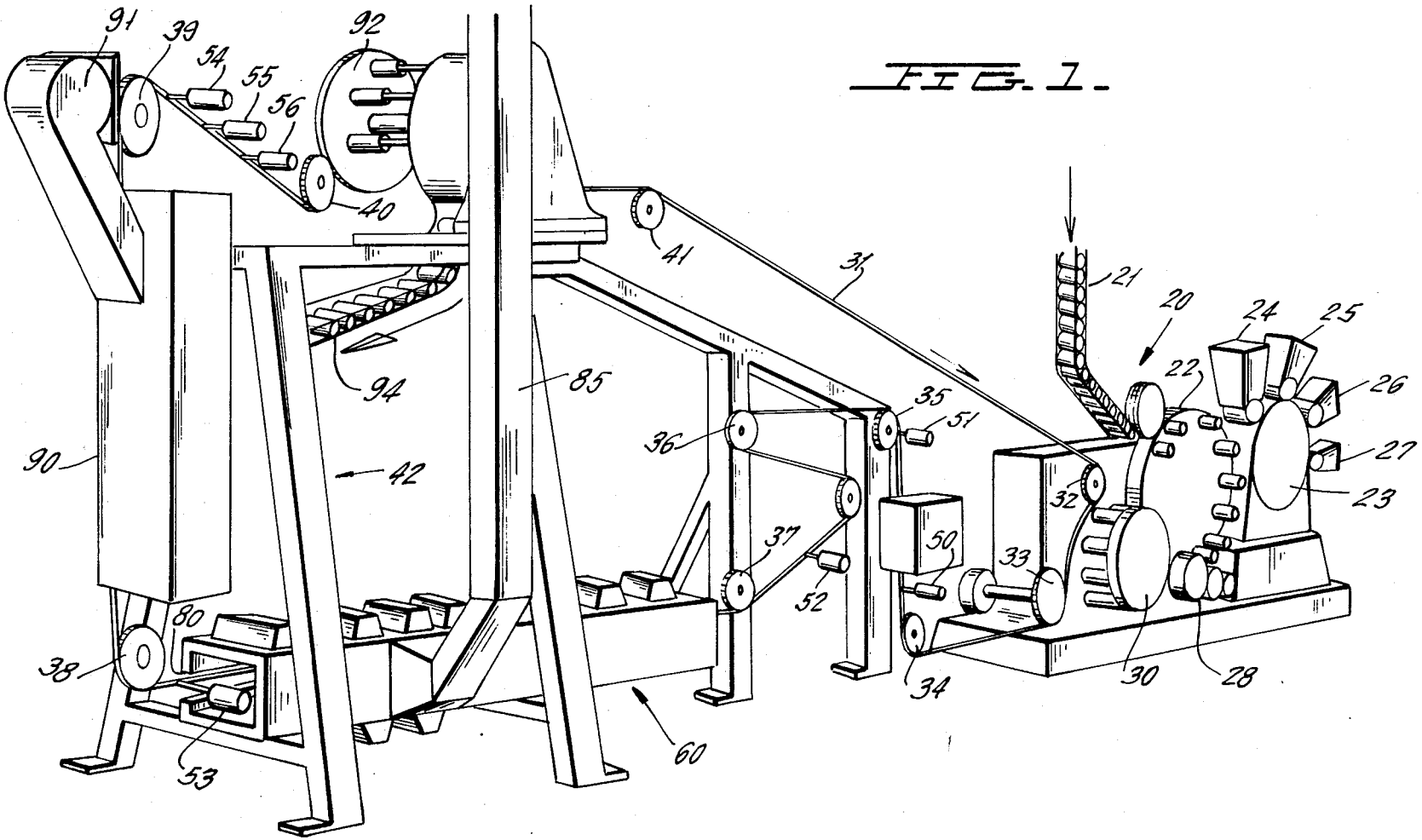
FIG. 1 is a perspective view of one embodiment of the system of the present invention.
Figure 3:
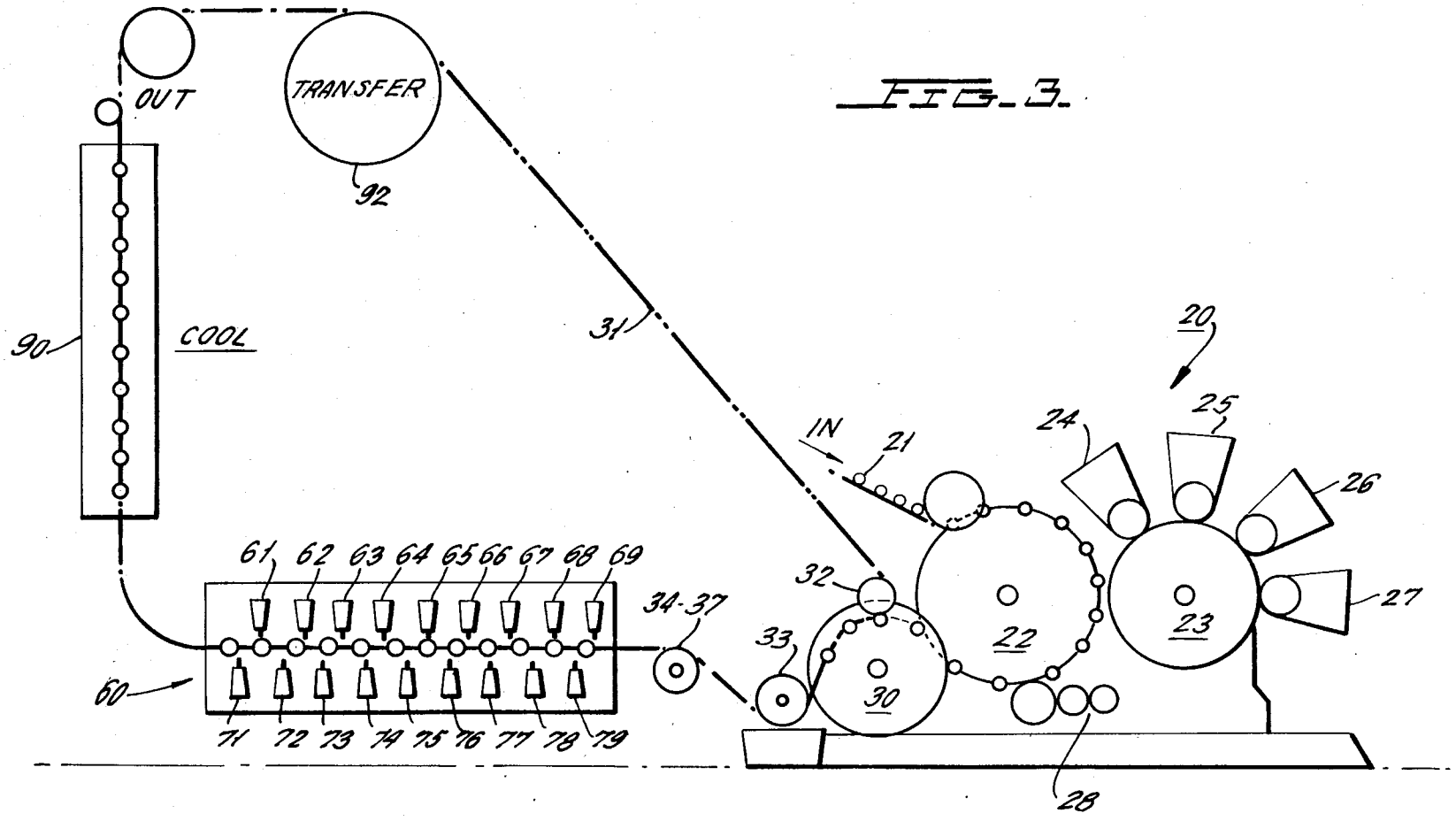
FIG. 3 is a schematic elevational view of the system of FIG. 1 and shows the flow of cans through the system.

Referring first to FIGS. 1 and 3, there is shown a can decorator 20 which may be of the type shown in U.S. Pat. No. 3,766,851, and which can place either heat setting coatings, printing and overvarnish, herein termed a decorating medium, on cylindrical objects such as cans. The decorator 20 of FIG. 1 consists of an undecorated can infeed conveyor 21, a can support mechanism 22 which moves the cans over a printing blanket 23, inker stages 24, 25, 26 and 27, and an overvarnish stage 28. Details of the construction of the decorator are contained in U.S. Pat. No. 3,766,851.

After the cans have been decorated, they move into transfer section 30 which transfers the decorated cans onto a conveyor pin chain 31. Conveyor pin chain 31 is a closed chain lying in a flat plane and having pins spaced from one another by about five inches and extending perpendicularly from the plane of the chain. These pins extend toward the open end of the decorated cans on the transfer mechanism 30, and the cans are deposited on the pins of the chain and are conveyed away from the decorator 20.

The conveyor chain 31 is guided around a closed loop over sprockets 32 to 41 (FIG. 1). The path taken by chain 31 is schematically shown in FIG. 3. The chain-guiding sprockets may be suitably supported by the can plant structure and can vary with each installation. Sprockets 34 to 41 may be supported from support frame 42, which is formed of suitable structural steel beams and, as best shown in FIG. 2, the chain 31 and thus sprockets 32 to 41 are in a plane which is tilted from the vertical by angle A, which may be about 10°. Note in FIG. 1 that the chain 31 is festooned around sprockets 34 to 37 to increase the time for the coating or varnish material to flow over its respective area on the can before curing of the coating or varnish. These sprockets may also act to control the tension of chain 31.

The conveyor chain 31 has pins extending perpendicularly from the plane of the chain, and cans, such as cans 50 to 56 (FIG. 1) have been deposited on such pins by the transfer device 30. These pins are spaced from one another by about 5 inches, so that a continuous row of cans can be deposited on adjacent respective pins at up to 800 or more cans per minute, with the conveyor chain moving at speeds up to and greater than about 350 feet per minute.

The wet cans on chain 31 are first conveyed into an air-gas fired flame dryer 60, which may contain a plurality of spaced burners which each project an open flame toward the path taken by the cans through the dryer 60. Dryer 60 may be from about 10 to 16 feet long. Thus, in FIG. 3, there are nine burners 61 to 69 above the path of the cans on pin chain 31 and nine burners 71 to 79 below the path of pin chain 31. Any desired number of burner heads could be used. Note that the burners 61 to 69 are longitudinally staggered relative to burners 71 to 79, respectively.

As best shown in FIG. 1, the flame dryer 60 has a longitudinal slot 80 therein to receive the pins extending from chain 31 and to permit their passage along the oven while cans suspended from the pins travel within the oven. Chain 31 can be disposed within oven 60.

Figure 8:
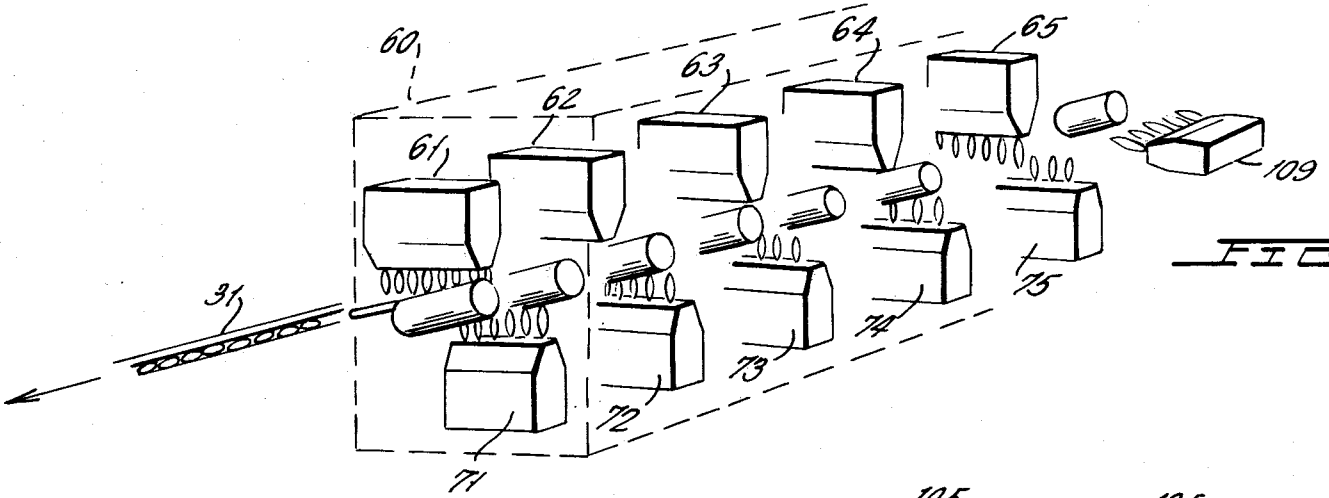
FIG. 8 illustrates, in perspective view, cans supported as in FIG. 7 moving through the flame dryer unit with the flame dryer housing shown in phantom view.

The burner arrangement shown in FIG. 3 is exemplary and other arrangements are possible. For example, FIG. 8 shows a staggered arrangement of burners above and below the chain path, with the housing shown in phantom view. Each of the burners in FIG. 8 extends perpendicularly to the path of movement of the chain 31, so that flame from each burner is applied across the full width of each of the cans passing through oven 60. An air exhaust duct 85 (FIG. 1) is connected to dryer housing 60 to exhaust the gases and solvents which may be produced during drying. Conventionally, the duct 85 may contain temperature sensing elements to control the exhaust fans to bring more or less air into the oven to maintain a constant, predetermined oven temperature. The exhaust gases may be recycled into the gas mixture used for the individual burners.

When the cans leave the flame dryer 60, they are completely dried, but may be too hot to permit further immediate processing. Thus, the cans are cooled before removal from the pins of chain 31. The cans can be cooled in air by providing a sufficiently long distance between a can removal mechanism and the dryer 60. Such cooling is preferably obtained in a cooling stage 90 which encloses the path of chain 31 and which contains rapidly moving, ambient air which is moved by fan 91. This cooling stage cools the cans sufficiently that they can be handled by any suitable can transfer mechanism 92 (FIGS. 1 and 3) which removes decorated cans from pin chain 31 and directs them into a can conveyor 94 which brings the cans to storage or to further processing locations. Note that in FIG. 3 both the flame dryer 60 and cooling chamber 90 are disposed at the angle defined by support structure 42.

The elongated cooling chamber 90 and flame dryer 60 could be physically arranged in many alignments relative to the decorator 20 which would best serve a desired flow of cans from the drying system. The arrangement of FIGS. 1 and 3 is schematically shown in FIG. 4*a* where the flame dryer 60 is horizontal and cooler 90 is vertical, with dried and cooled cans being discharged from the top of cooler 90. FIG. 4*b* shows that cooler 90 can be horizontal and disposed above dryer 60. The cooler 90 can also be placed in line with dryer 60 as in FIG. 4*c*. While the flame dryer 60 was shown as being horizontally disposed, it could also be vertical as shown in FIGS. 4*d* and 4*e*, with the cooler 90 being horizontal or vertical as in FIGS. 4*d* and 4*e*, respectively.

Figure 5:
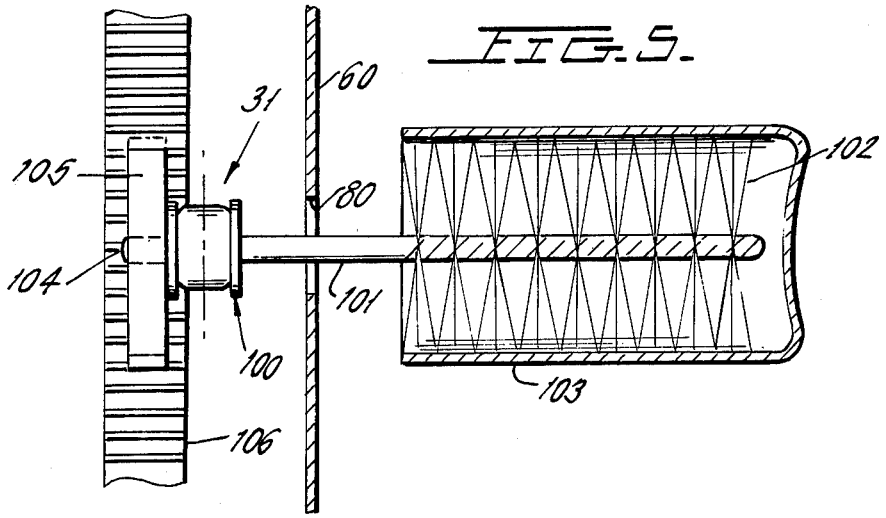
FIG. 5 is a cross-sectional view of one embodiment employing a wire brush for supporting cans on the conveyor chain of the preceding figures.

FIG. 5 illustrates one type of can support which can be used to carry a can on a conveyor chain pin. Thus, in FIG. 5, the chain 31 has a link 100 which has a pin 101 extending therefrom. A wire brush 102 extends from pin 101 which may have a diameter slightly greater than the inner diameter of can 103 which is to be supported on pin 101. By mounting the can on a brush 102, the can position relative to chain 31 is fixed, and the can, while easily removed from brush 102, will not fall off the pin 101 due to vibration, or the like.

If it is desired to rotate the can as it passes through flame dryer 60, the pin 101 can be journaled in link 100 and can have a leftwardly extending portion 104 fixed or in contact with a wheel 105 which frictionally engages friction strip 106 which is mounted on dryer 60. Thus, as chain 31 and wheel 105 move along dryer 60, wheel 105 rotates, and can 103 rotates inside the dryer 60. The arrangement for rotatably mounting can 103 within the drying oven is shown in detail in U.S. Pat. No. 3,840,999.

Figure 6:
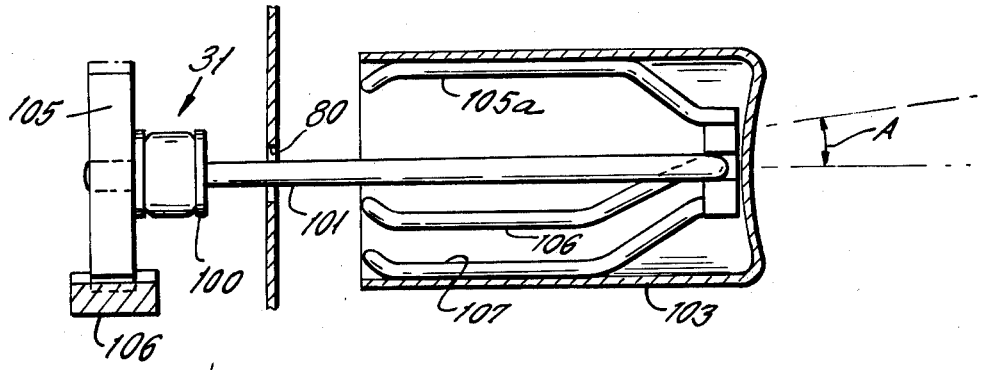
FIG. 6 is similar to FIG. 5 but shows the use of flexible fingers for gripping the can interior, rather than a wire brush.

FIG. 6 is similar to FIG. 5 except that it is a vertical cross-section of the flame dryer 60 of FIG. 1, while FIG. 5 is a horizontal cross-section, and a cluster of spring fingers, such as spring fingers 105*a*, 106 and 107 replace the wire brush 102 of FIG. 5. Note that FIG. 6 illustrates that pin 101 and chain 31 can be disposed at an angle A of about 10° when chain 31 is mounted as shown in FIGS. 1 and 2.

Figure 7:
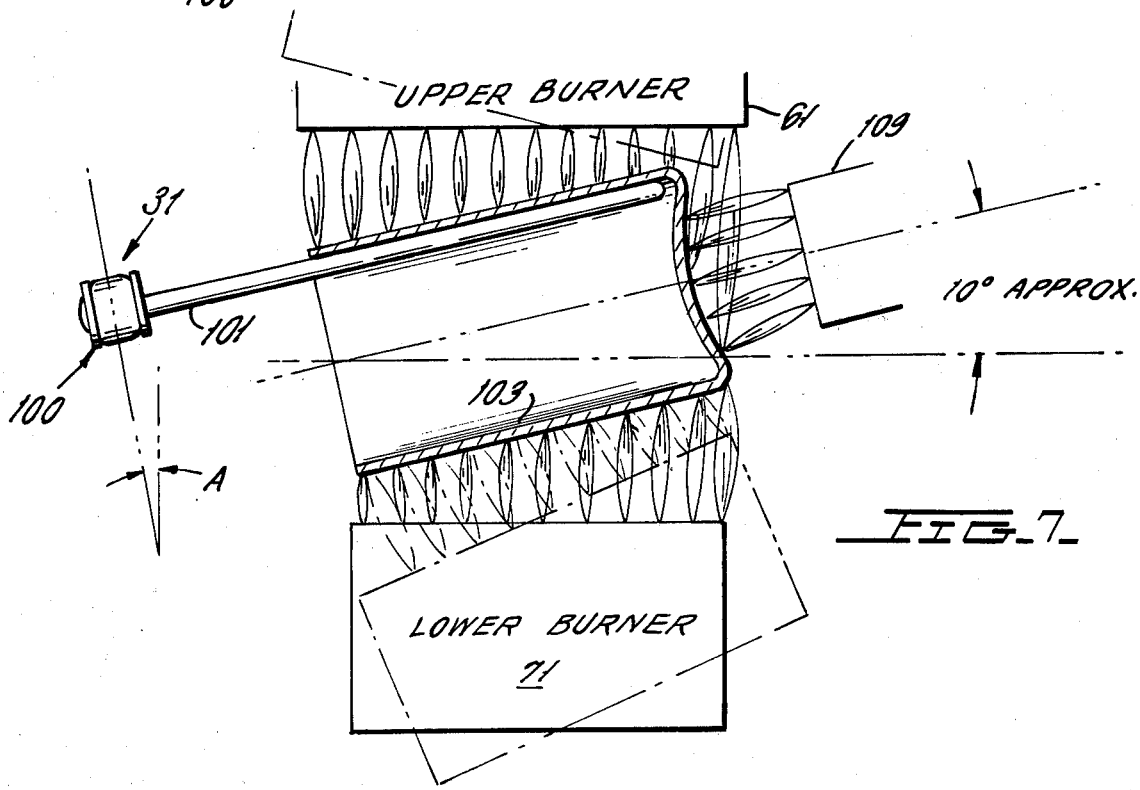
FIG. 7 shows a further embodiment for supporting cans on the pin chain consisting of a simple pin pitched at some angle to the horizontal to retain the can on the pin, and further shows the disposition of flame burners on opposite sides of the cans and on the can ends in the path to be traveled by cans moving through the flame dryer unit.

FIG. 7 illustrates the disposition of can 103 directly on pin 101 without the further brush or spring finger support of FIGS. 5 and 6. In this embodiment, the chain 31 should be tilted to prevent the cans from falling off their pins. FIG. 7 also shows the disposition of the can 103 relative to burners 61 and 71. Note that the can 103 is angularly displaced relative to the horizontal as are all other cans on chain 31. In this arrangement, the upper burners including burner 61 play on the heavier bottom end of the can where the can material acts as a better heat sink than at the thinner open end of can 103. The lower burners may be used or eliminated, if desired. The lower burners including burner 71 can also be disposed as shown in dotted lines so that the right-hand side of burner 71 is closer to the bottom of can 103 than is the left-hand end, further concentrating flame energy on the bottom end of can 103. Note that can 103 could be rotated about its axis, if desired, in the embodiment of FIG. 7. FIG. 7 further illustrates an end burner 109 for applying flame to the ends of the cans 103. A plurality of end burners 109 may be distributed along the can path. One such end burner 109 is also shown in FIG. 8.

Figure 9:
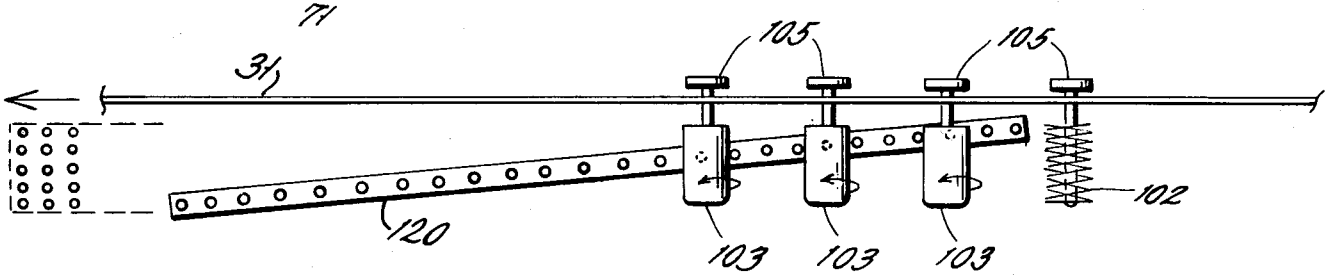
FIG. 9 is a top view of a further embodiment of the flame dryer burner heads.
Figure 10:
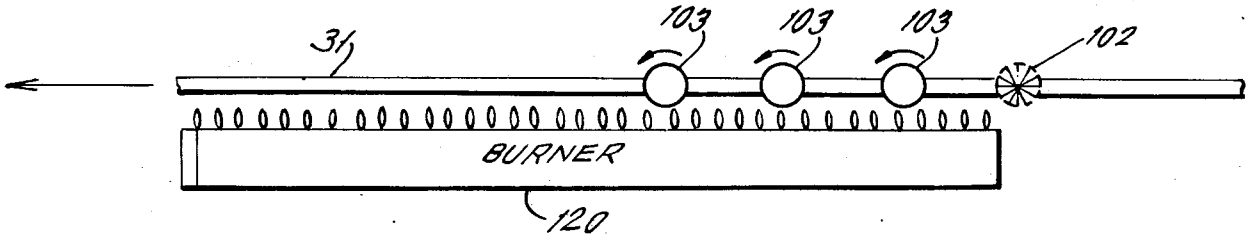
FIG. 10 is a side view of the burner head arrangement of FIG. 9.

FIGS. 9 and 10 show an embodiment of the invention wherein a single elongated burner head 120 is disposed beneath the path of chain 31 and is in a plane which is parallel to the chain 31. The burner head 120 is elongated and is obliquely located relative to the path followed by cans 103 so that, as the cans 103 travel along their path in dryer 60, the flame sweeps along their length from open end to closed end. The cans 103 are mounted on wire brushes 102 and are arranged to rotate, as described in FIG. 5, as they move through oven 60 and over oven burner 120. Thus, flame from burner 120 is applied over the full can surface as it moves through the dryer.

FIGS. 11 and 12 illustrate a novel embodiment for dryer 60 wherein only the upper row of burners, including burners 61 to 63, is used with the cans 103 on pins 101 moving under burners 61 to 63. In FIG. 11, the housing of dryer 60 is fitted with an intermediate trough 130 of heatresistant material, such as a sheet metal. The trough in FIGS. 11 and 12 will act as a barrier to the hot air stream produced by the burners, and redirects the hot air upwardly, and back toward the cans 103, as schematically illustrated in FIG. 12 by arrows representing hot air flow. This arrangement increases the efficiency of the dryer, redirecting the hot air stream back toward the cans to be dried. As further shown in FIG. 12, the burners 61, 62 and 63 can be rotated to the dotted-line position shown, and may be non-perpendicular to the plane of the axes of the cans 103.

Figure 13:
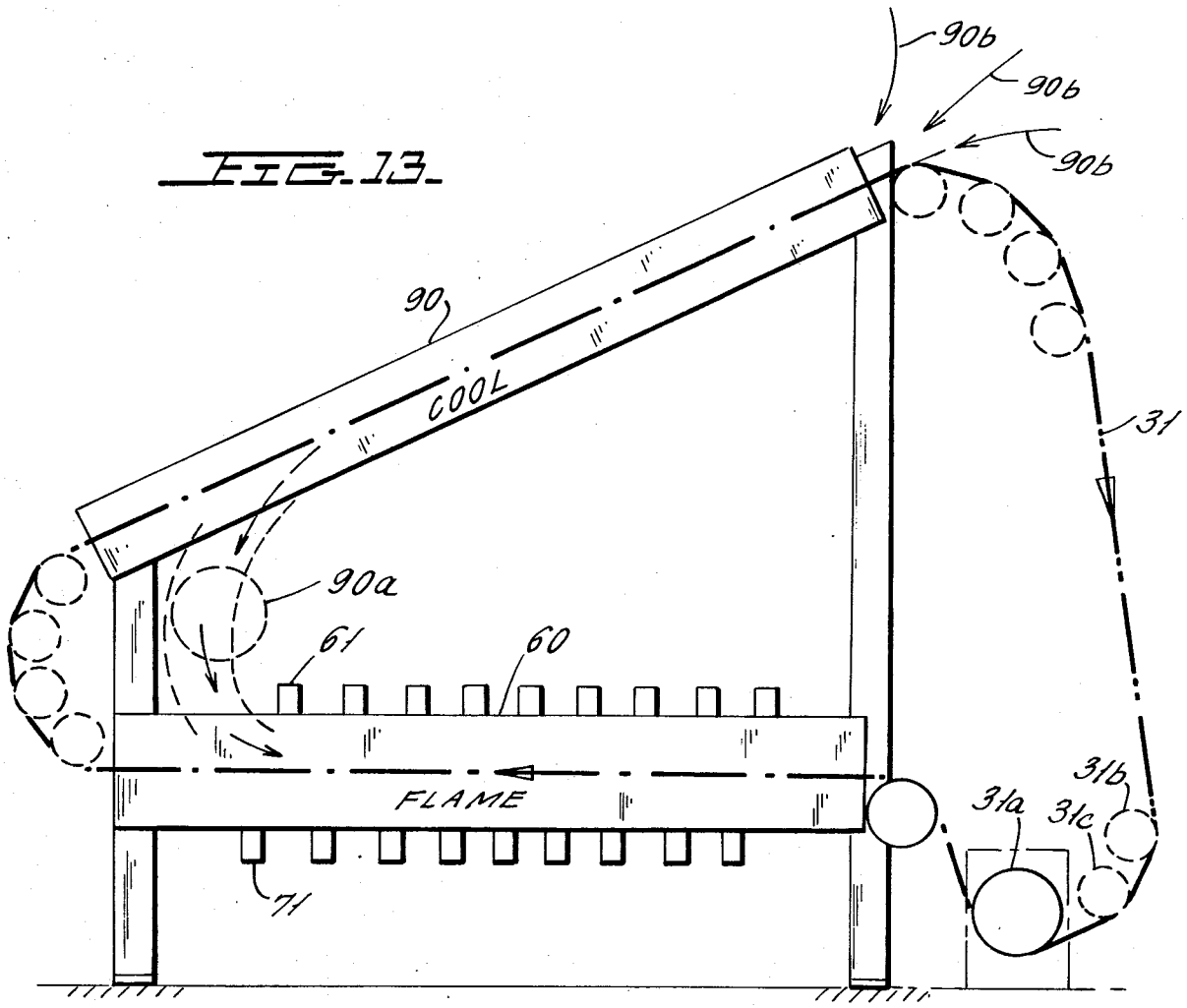
FIG. 13 is an elevational view of a further embodiment of an arrangement for the flame drying and cooling stages.

FIG. 13 shows a modified arrangement for the cooling stage 90 wherein the cooling stage is disposed above the flame dryer 60 and extends upwardly at about a 30° angle to the horizontal. This disposition of the cooling stage 90 permits the cooling stage to have a longer length than the flame drying stage 60, while still occupying the same amount of floor space as is occupied by the dryer 60 alone.

It will be noted in FIG. 13 that the closed chain 31 circulates around the full system and that a drive motor 31*a* drives the closed pin-chain 31 over suitable rollers, including a set of chain-take-up rollers 31*b* and 31*c*. Note further that the blower arrangement for the cooling chamber 90, shown as blower 90*a*, can exhaust air from the cooling chamber 90 into the flame dryer 60 as schematically illustrated. Note further that the air intake into the chamber 90 can come into the end of the cooler, as illustrated by the arrows 90*b*.

FIG. 14 schematically illustrates a burner housing 200 which is essentially similar to the dryer 60 of the preceding figures except that the chain 31, carrying cans 103, executes a 90° change in direction through the burners. Thus, the cans 103 carried on conveyor chain 31 move in a first direction past burners 201 to 204, whereby the opposite lateral sides of the can are exposed to the flame of the burners and thereafter the chain executes a 90° turn, by going over the sprocket 205, and the cans are next exposed to burners 206 to 209 which play upon the top and bottom surfaces of the cans. Thus, the full surface of the cans are exposed to flame even though the cans are not rotated.

Figure 15:
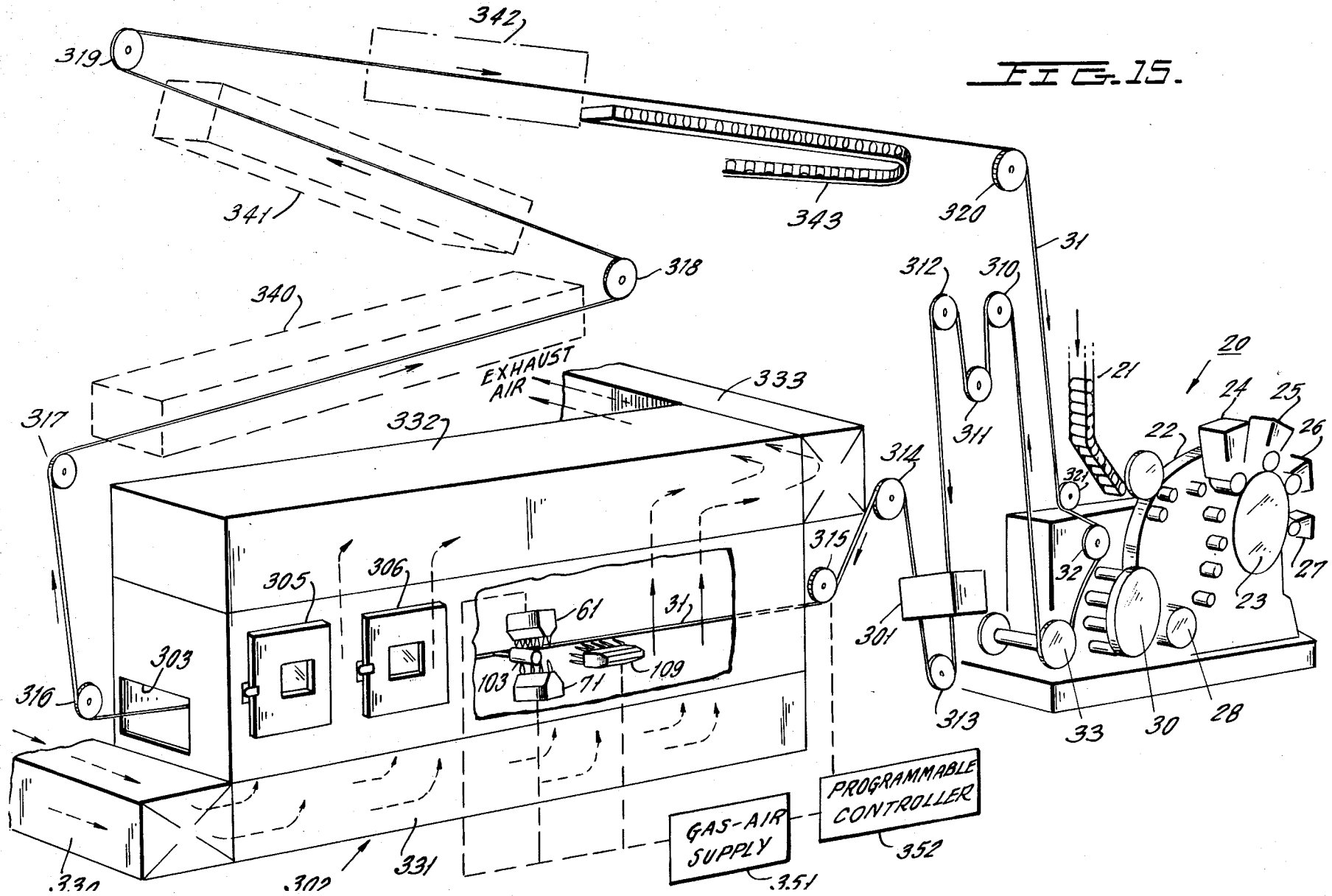
FIG. 15 is a perspective view of a further embodiment of the invention.

FIG. 15 shows a further embodiment of the novel oven of the invention, wherein the oven is somewhat different in configuration from that of FIG. 1. In FIG. 15, the decorator unit 20 is similar to the decorator of FIG. 1 and its components are given similar identifying numerals. A bottom varnish unit 301, of conventional construction, is disposed downstream of the decorator 20 as shown, and the flame drying oven 302 is downstream of the bottom varnish unit 301. Oven 302 is a metal enclosed, self-supported unit which can be placed on the can plant floor. The oven 302 contains an enclosed oven space which receives pluralities of burners along the can path such as burners 61, 71 and 109, shown in the broken-away wall section in FIG. 15. Only one can 103 and one set of burners 61, 71 and 109 are shown in FIG. 15. The can path through the oven extends from an oven entrance (not shown) to an oven exit 303. Note that the chain 31 and its can support members, which can be of the type described in the embodiments heretofore described, can be contained within the oven housing of FIG. 15. Inspection doors, such as doors 305 and 306, permit access to the interior of the oven.

The pin-chain 31 in FIG. 15 is supported by sprockets suitably mounted within the can plant, including chain take-up sprockets 310, 311 and 312, and chain guiding sprockets 313 to 321. Air is supplied to the oven through air intake ducts 330, 331, and the air flows through the oven in the direction of the dotted-line arrows to air exhaust ducts 332, 333. A blower in duct 333 is suitably controlled to maintain a preselected temperature for the exhaust air, which in turn is related to a desired temperature within the oven.

Pin chain 31 in FIG. 15 is preferably at an angle of about 10° to the vertical to help keep cans 103 from being accidentally shaken off their pins. The pin chain 31 may be festooned through overhead forced air cooldown chambers 340 and 341 if needed, and are then removed from pin chain 31 by a suitable transfer mechanism 342 (which could be similar to mechanism 92 of FIG. 1), and the dried cans are then put into discharge trackage 343 to be taken to storage or further processing.

It is desirable to control the burners, in intensity, and in some cases in the numbers of burners used, as a function of the speed of chain 31. Thus, when chain 31 moves at a relatively low speed, the flame applied by each burner and/or the number of burners which should be operating should be reduced. To this end, a programmable controller 352 is provided and is connected to the chain 31 as at sprocket 315. The controller output, which is a function of the speed of chain 31, then controls suitable gas-air supply valves 351 which suitably control the supply of gas and air to the various burners.

Although the present invention has been described with respect to its preferred embodiments, it should be understood that many variations and modifications will now be obvious to those skilled in the art, and it is preferred, therefore, that the scope of the invention be limited not by the specific disclosure herein, but only by the appended claims.

1. A system for decorating hollow cylindrical objects comprising, in combination:

a supply system for continuously supplying hollow cylindrical objects to a discharge region, decorating means receiving hollow cylindrical objects from said discharge region and containing hollow cylindrical object moving means for moving said hollow cylindrical objects from said discharge region, a source of thermally settable decorating medium, and means disposed along the path of movement of said hollow cylindrical objects for applying thermally settable decorating medium from said source of thermally settable decorating medium to at least portions of the outer surface of said hollow cylindrical objects, a continuously moving conveyor pin chain for conveying hollow cylindrical objects with said decorating medium thereon away from said decorating means; said continuously moving conveyor pin chain comprising a generally closed chain disposed in a generally vertical plane, and having spaced pins extending therefrom in a generally horizontal direction; each of said pins being adapted to receive a hollow cylindrical object thereon and to suspend and move said hollow cylindrical object in the direction of movement of said pin and said chain, a hollow cylindrical object transfer means for transferring cans from said decorating means to said conveyor pin chain after said hollow cylindrical objects have decorating medium applied thereto, and a flame drying oven for thermally curing the decorating medium on said hollow cylindrical objects; said flame drying oven comprising an elongated chamber having gas fired burner head means disposed therein and operable to produce an open gas flame jet; said continuously moving conveyor pin chain being disposed to have a travel region which is parallel to said elongated chamber, with said pins on said chain being disposed within said chamber and moving relative to said burner head means so that said open gas flame jet is applied directly to the decorating medium on the hollow cylindrical objects on said pins for a length of time sufficient to thermally cure said decorating medium;

said oven being spaced from said decorating means by a length of conveyor chain at least sufficient to permit the decorating medium on said hollow cylindrical objects to flow to an evenly distributed condition free of thickened ridges, the rate of movement of said chain, and the length of said burner head means in the direction of movement of said chain being such that said decorating medium on said hollow cylindrical objects is exposed to said open gas flame jet for a time less than about three seconds, and for a time long enough to thermally cure said decorating medium.

2. The system of claim 1 which further includes second hollow cylindrical object transfer means disposed adjacent said conveyor chain at a location along said chain removed from the discharge end of said flame drying oven for removing hollow cylindrical objects with dried decorating medium from said pins of said chain before said chain recirculates to said hollow cylindrical object transfer means which transfers hollow cylindrical objects from said decorating means to said conveyor pin chain.

3. The system of claim 2 which further includes a hollow cylindrical object cooling region disposed between said flame drying oven and said second hollow cylindrical object transfer means.

4. The system of claim 3 wherein said hollow cylindrical object cooling region consists of a cooling chamber having said pins of said pin chain conveyor and hollow cylindrical objects thereon moved therethrough, whereby said hollow cylindrical objects are cooled within said cooling chamber to a temperature low enough to permit transfer of hollow cylindrical objects by said second hollow cylindrical object transfer means.

5. The system of claim 1 wherein said generally vertical plane of said conveyor pin chain is tilted from the vertical by about 10°, and whereby said pins on said pin chain are tilted from the horizontal by about 10°, with the extending free end of said pins being above the chain end of said pins.

6. The system of claim 4 wherein said generally vertical plane of said conveyor pin chain is tilted from the vertical by about 10°, and whereby said pins on said pin chain are tilted from the horizontal by about 10°, with the extending free end of said pins being above the chain end of said pins.

7. The system of claim 1 wherein each of said pins has resilient means extending therefrom for internally gripping the hollow cylindrical object disposed thereon and locating the axis of said hollow cylindrical object on the axis of its respective pin.

8. The system of claim 5 wherein each of said pins has resilient means extending therefrom for internally gripping the hollow cylindrical object disposed thereon and locating the axis of said hollow cylindrical object on the axis of its respective pin irrespective of the elevated angle of said pin to the horizontal.

9. The system of claim 6 wherein each of said pins has resilient means extending therefrom for internally gripping the hollow cylindrical object disposed thereon and locating the axis of said hollow cylindrical object on the axis of its respective pin irrespective of the elevated angle of said pin to the horizontal.

10. The system of claim 1 wherein said hollow cylindrical objects have an open end and a closed end, the closed end of said hollow cylindrical objects being closer to the free ends of said pins then to the ends of said pins connected to said chain, and wherein said burner head means includes a plurality of burners spaced from one another along the hollow cylindrical object path within said oven, wherein each of said burners is disposed generally perpendicularly to the direction of movement of said hollow cylindrical objects; said burners having flat outlet jet surfaces which are disposed at an angle greater than 0° and less than about 10° to the axis of said pins, with said burner surface being closer to the free ends of said pins than to the end of said pins connected to said chain.

11. The system of claim 4 wherein said hollow cylindrical objects have an open end and a closed end, the closed end of said hollow cylindrical objects being closer to the free ends of said pins than to the ends of said pins connected to said chain, and wherein said burner head means includes a plurality of burners spaced from one another along the hollow cylindrical object path within said oven, wherein each of said burners is disposed perpendicularly to the direction of movement of said hollow cylindrical objects; said burners having flat outlet jet surfaces which are disposed at an angle greater than 0° and less than about 10° to the axis of said pins, with said burner surface being closer to the free ends of said pins than to the end of said pins connected to said chain.

12. The system of claim 5 wherein said hollow cylindrical objects have an open end and a closed end, the closed end of said hollow cylindrical objects being closer to the free ends of said pins than to the ends of said pins connected to said chain, and wherein said burner head means includes a plurality of burners spaced from one another along the hollow cylindrical object path within said oven, wherein each of said burners is disposed perpendicularly to the direction of movement of said hollow cylindrical objects; said burners having flat outlet jet surfaces which are disposed at an angle greater than 0° and less than about 10° to the axis of said pins, with said burner surface being closer to the free ends of said pins than to the end of said pins connected to said chain.

13. The system of claim 10 wherein said plurality of burners are disposed both above and below the path of movement of said hollow cylindrical objects through said dryer oven.

14. The system of claim 12 wherein said plurality of burners are disposed both above and below the path of movement of said hollow cylindrical objects through said dryer oven.

15. The system of claim 7 which further includes pin rotation means for rotating said pins and the hollow cylindrical objects thereon on their axis and within said oven.

16. The system of claim 9 which further includes pin rotation means for rotating said pins and the hollow cylindrical objects thereon on their axis and within said oven.

17. The system of claim 10 which further includes pin rotation means for rotating said pins and the hollow cylindrical objects thereon on their axis and within said oven.

18. The system of claim 1 wherein said burner head means includes an elongated burner head disposed generally along the length and at a small angle thereto of the path of hollow cylindrical objects through said oven.

19. The system of claim 15 wherein said burner head means includes an elongated burner head disposed generally along the length and at a small angle thereto of the path of hollow cylindrical objects through said oven.

20. The system of claim 1 wherein said oven has an elongated heat reflecting trough therein which extends along and is spaced from the bottom of said elongated chamber, and which is on the side of said hollow cylindrical object path which is opposite to said burner head means, whereby said elongated trough reflects hot gas from said burner head means back toward hollow cylindrical objects moving along the hollow cylindrical object path within said oven.

21. The system of claim 7 wherein said oven has an elongated heat reflecting trough therein which extends along and is spaced from the bottom of said elongated chamber, and which is on the side of said hollow cylindrical object path which is opposite to said burner head means, whereby said elongated trough reflects hot gas from said burner head means back toward hollow cylindrical objects moving along the hollow cylindrical object path within said oven.

22. The system of claim 10 wherein said oven has an elongated heat reflecting trough therein which extends along and is spaced from the bottom of said elongated chamber, and which is on the side of said hollow cylindrical object path which is opposite to said burner head means, whereby said elongated trough reflects hot gas from said burner head means back toward hollow cylindrical objects moving along the hollow cylindrical object path within said oven.

23. The system of claim 15 wherein said oven has an elongated heat reflecting trough therein which extends along and is spaced from the bottom of said elongated chamber, and which is on the side of said hollow cylindrical object path which is opposite to said burner head means, whereby said elongated trough reflects hot gas from said burner head means back toward hollow cylindrical objects moving along the hollow cylindrical object path within said oven.

24. The system of claim 4 wherein said oven is generally horizontally disposed and wherein said cooling chamber is generally vertically disposed.

25. The system of claim 4 wherein said oven is generally horizontally disposed and wherein said cooling chamber is generally horizontally disposed.

26. The system of claim 4 wherein said oven is generally horizontally disposed and wherein said cooling chamber is disposed at an angle of between about 30° to 60° to the horizontal, and is disposed above said oven.

27. The system of claim 10 which further includes a second plurality of burners spaced from one another along said hollow cylindrical object path within said oven and disposed in the plane of said hollow cylindrical objects and arranged to flame toward the closed end of said hollow cylindrical objects.

28. The system of claim 1 wherein said oven includes first and second path segments at an acute angle to one another which is less than 180°; said first path segment including first and second pluralities of burners disposed on opposite sides of said hollow cylindrical objects; said second path segment including third and fourth pluralities of burners disposed on opposite sides of said hollow cylindrical objects but positioned in such a manner as to subject portions of said hollow cylindrical objects to direct flame which were not subjected to direct flame by said first and second plurality of burners.

* * * * *